US011382384B2

(12) United States Patent
Ochipa

(10) Patent No.: US 11,382,384 B2
(45) **Date of Patent: *Jul. 12, 2022**

(54) SHOE DRAINAGE SYSTEM

(71) Applicant: S9, LLC, Bonita Springs, FL (US)

(72) Inventor: Matthew Ochipa, Fort Myers, FL (US)

(73) Assignee: S9, LLC, Bonita Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/875,571

(22) Filed: May 15, 2020

(65) Prior Publication Data

US 2020/0275733 A1 Sep. 3, 2020

Related U.S. Application Data

(63) Continuation of application No. 15/159,645, filed on May 19, 2016, now Pat. No. 10,653,203.

(60) Provisional application No. 62/165,314, filed on May 22, 2015.

(51) Int. Cl.

| | |
|---|---|
| ***A43B 5/08*** | (2006.01) |
| ***A43B 7/08*** | (2022.01) |
| ***A43B 7/10*** | (2022.01) |

(52) U.S. Cl.

CPC ..... *A43B 5/08* (2013.01); *A43B 7/087* (2013.01); *A43B 7/10* (2013.01)

(58) Field of Classification Search

CPC ..... A43B 5/08; A43B 7/087; A43B 7/10
USPC ..... 36/3 B, 8.1
See application file for complete search history.

(56) References Cited

U.S. PATENT DOCUMENTS

| | | | | |
|---|---|---|---|---|
| 417,858 | A | 12/1889 | Church | |
| 418,966 | A | 1/1890 | Welander | |
| 997,658 | A | 7/1911 | Duncan | |
| 1,202,827 | A | 10/1916 | Gerhold | |
| 1,742,772 | A * | 1/1930 | Langan | A43B 7/06 36/3 B |
| 2,327,043 | A | 8/1943 | Hirsch | |
| 4,525,940 | A | 7/1985 | Mochizuki | |
| 4,771,555 | A | 9/1988 | Ohashi | |
| 4,837,948 | A | 6/1989 | Cho | |
| 5,551,172 | A | 9/1996 | Yu | |

(Continued)

OTHER PUBLICATIONS

U.S. Appl. No. 62/165,314, filed May 22, 2015.

*Primary Examiner* — Sharon M Prange
(74) *Attorney, Agent, or Firm* — Craig R. Miles; CR Miles P.C.

(57) ABSTRACT

A closable drainage system for a sole of a shoe, the closable drainage system including a drain configured to communicate between sole top and bottom surfaces of the sole, the drain having opposing drain upper and lower faces; at least one drainage aperture element disposed within the drain, the drainage aperture element defining a drainage channel which communicates between the drain upper and lower faces; and a movable member overlaying the drain upper face, the movable member movable over the drain upper face to provide open and closed conditions of the drainage channel; whereby in the open condition, the movable member disposes to allow passage through the drainage channel and correspondingly, between the sole top and bottom surfaces; and whereby in the closed condition, the movable member disposes to preclude passage through the drainage channel and correspondingly, between the sole top and bottom surfaces.

19 Claims, 6 Drawing Sheets

(56) References Cited

U.S. PATENT DOCUMENTS

| | | | | |
|---|---|---|---|---|
| 6,408,540 | B1 | 6/2002 | DeKalb et al. | |
| 6,742,287 | B2 | 6/2004 | DeKalb et al. | |
| 6,817,112 | B2 | 11/2004 | Berger et al. | |
| 6,874,252 | B2 | 4/2005 | Nakano | |
| 7,210,248 | B2 | 5/2007 | Van Noy et al. | |
| 7,503,130 | B2 | 3/2009 | Helton et al. | |
| 7,726,041 | B2 | 6/2010 | Woo et al. | |
| 8,001,702 | B1 | 8/2011 | Wasserman | |
| 8,109,012 | B2 | 2/2012 | Sarantakos et al. | |
| 8,479,411 | B1 | 7/2013 | Quinones | |
| 9,480,297 | B2 | 11/2016 | Kim | |
| 10,653,203 | B2 | 5/2020 | Ochipa | |
| 2004/0074107 | A1* | 4/2004 | Tuan | A43B 7/10 36/3 R |
| 2007/0214681 | A1 | 9/2007 | Sezfouli | |
| 2007/0240333 | A1 | 10/2007 | Le et al. | |
| 2011/0162239 | A1 | 7/2011 | Bier et al. | |
| 2011/0162240 | A1 | 7/2011 | Pieri | |
| 2016/0206037 | A1 | 7/2016 | McCormick | |

* cited by examiner

SHOE DRAINAGE SYSTEM

This U.S. Patent Application is a continuation of U.S. patent application Ser. No. 15/159,645, filed May 19, 2016, now U.S. Pat. No. 10,653,203, issued May 19, 2020, which claims the benefit of U.S. Provisional Patent Application No. 62/165,314, filed May 22, 2015, hereby incorporated by reference herein.

I. SUMMARY OF THE INVENTION

A broad object of a particular embodiment of the invention can be to provide a closable drainage system for a sole of a shoe, and methods of making and using such a closable drainage system, whereby the closable drainage system includes a drain configured to communicate between sole top and bottom surfaces of the sole, the drain having opposing drain upper and lower faces; at least one drainage aperture element disposed within the drain, the drainage aperture element defining a drainage channel which communicates between the drain upper and lower faces; and a movable member overlaying the drain upper face, the movable member movable over the drain upper face to provide open and closed conditions of the drainage channel; whereby in the open condition, the movable member disposes to allow passage through the drainage channel and correspondingly, between the sole top and bottom surfaces; and whereby in the closed condition, the movable member disposes to preclude passage through the drainage channel and correspondingly, between the sole top and bottom surfaces.

Naturally, further objects of the invention are disclosed throughout other areas of the specification, drawings, and claims.

II. A BRIEF DESCRIPTION OF THE DRAWINGS

III. DETAILED DESCRIPTION OF THE PREFERRED EMBODIMENTS

Figure 1:
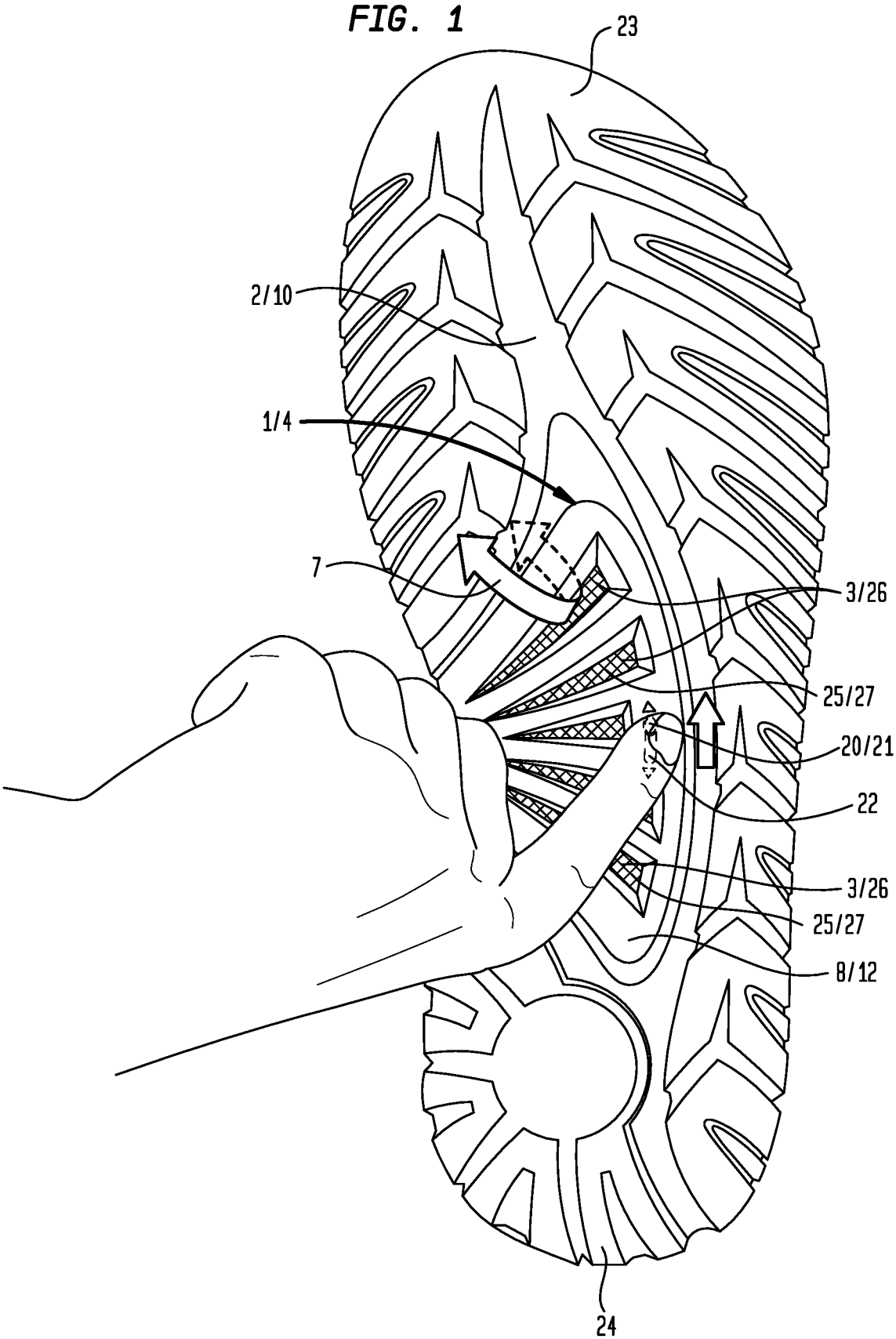
FIG. 1 is an illustration of a method of using a particular embodiment of the closable drainage system for a sole portion of a shoe, whereby a movable member can be moved to provide an open condition of a drainage channel to allow passage through the drainage channel and correspondingly, between sole top and bottom surfaces.
Figure 2:
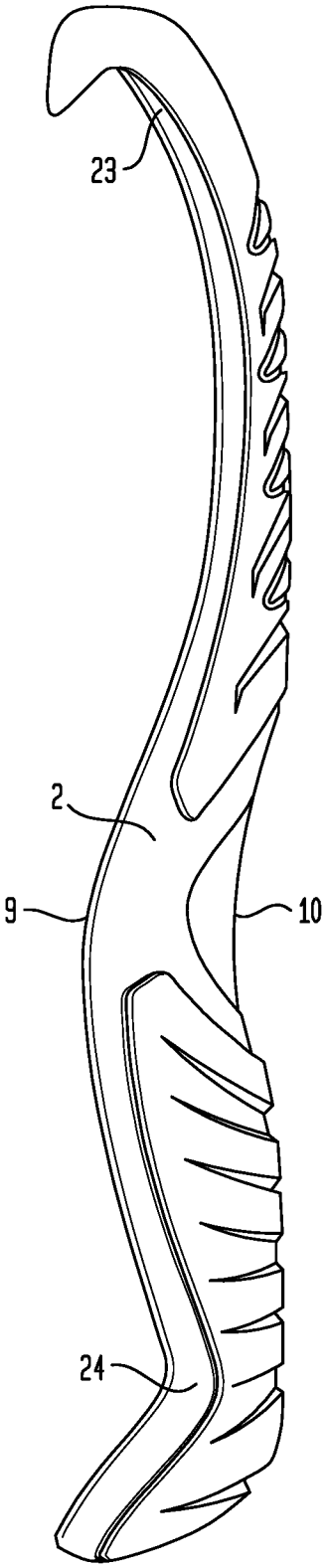
FIG. 2 is a first side view of a particular embodiment of a sole of a shoe which includes the closable drainage system.
Figure 3:
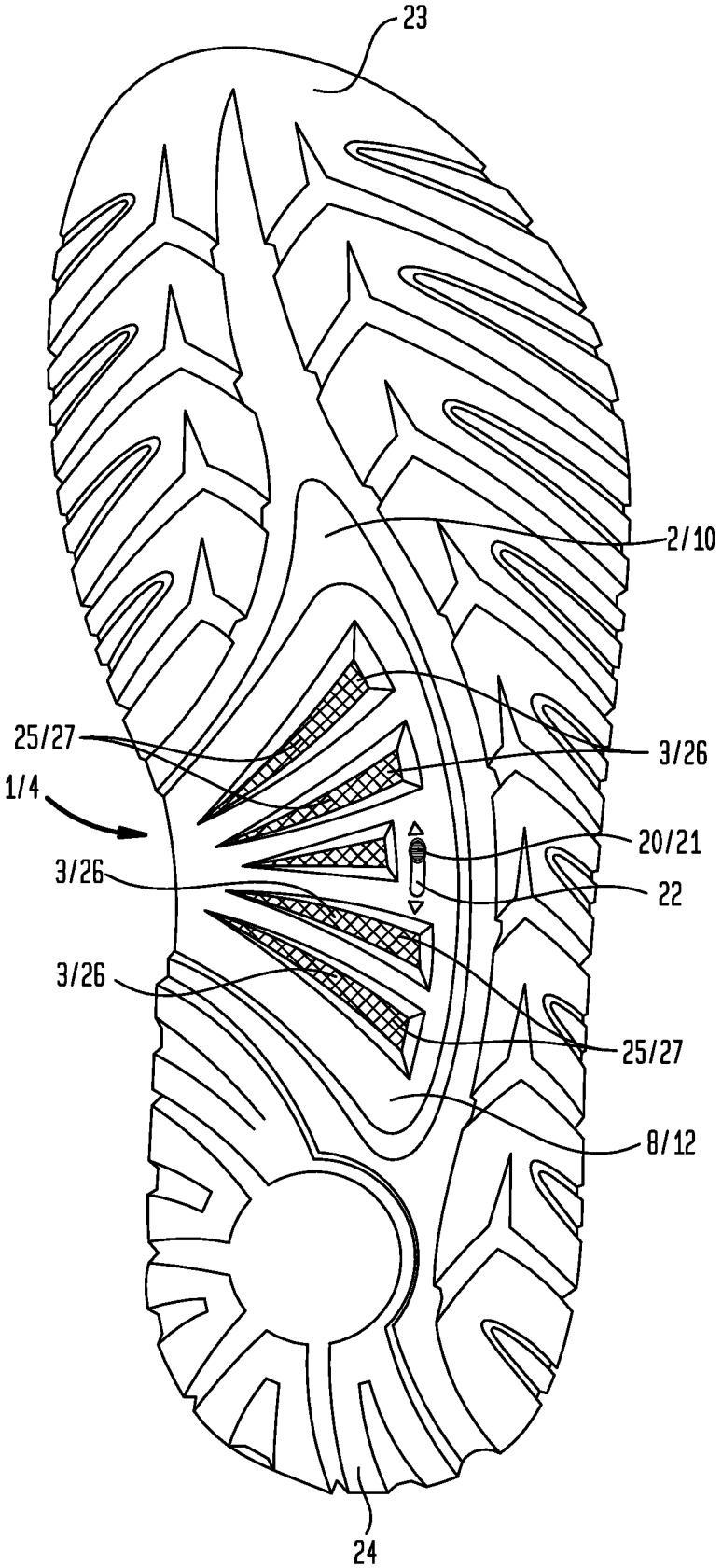
FIG. 3 is a bottom view of the particular embodiment of the sole and closable drainage system shown in FIG. 2.
Figure 4:
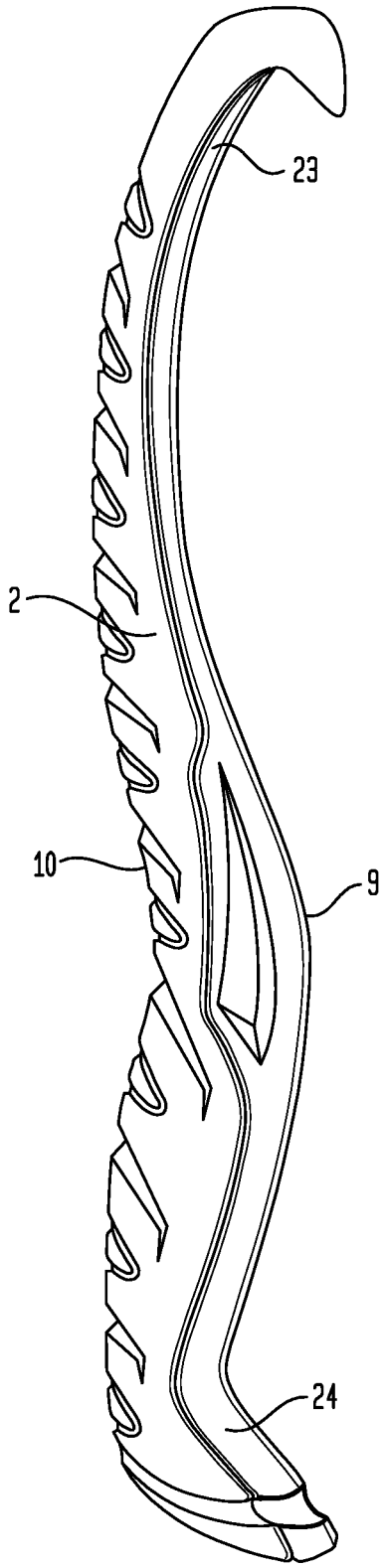
FIG. 4 is a second side view of the particular embodiment of the sole and closable drainage system shown in FIG. 2.
Figure 5:
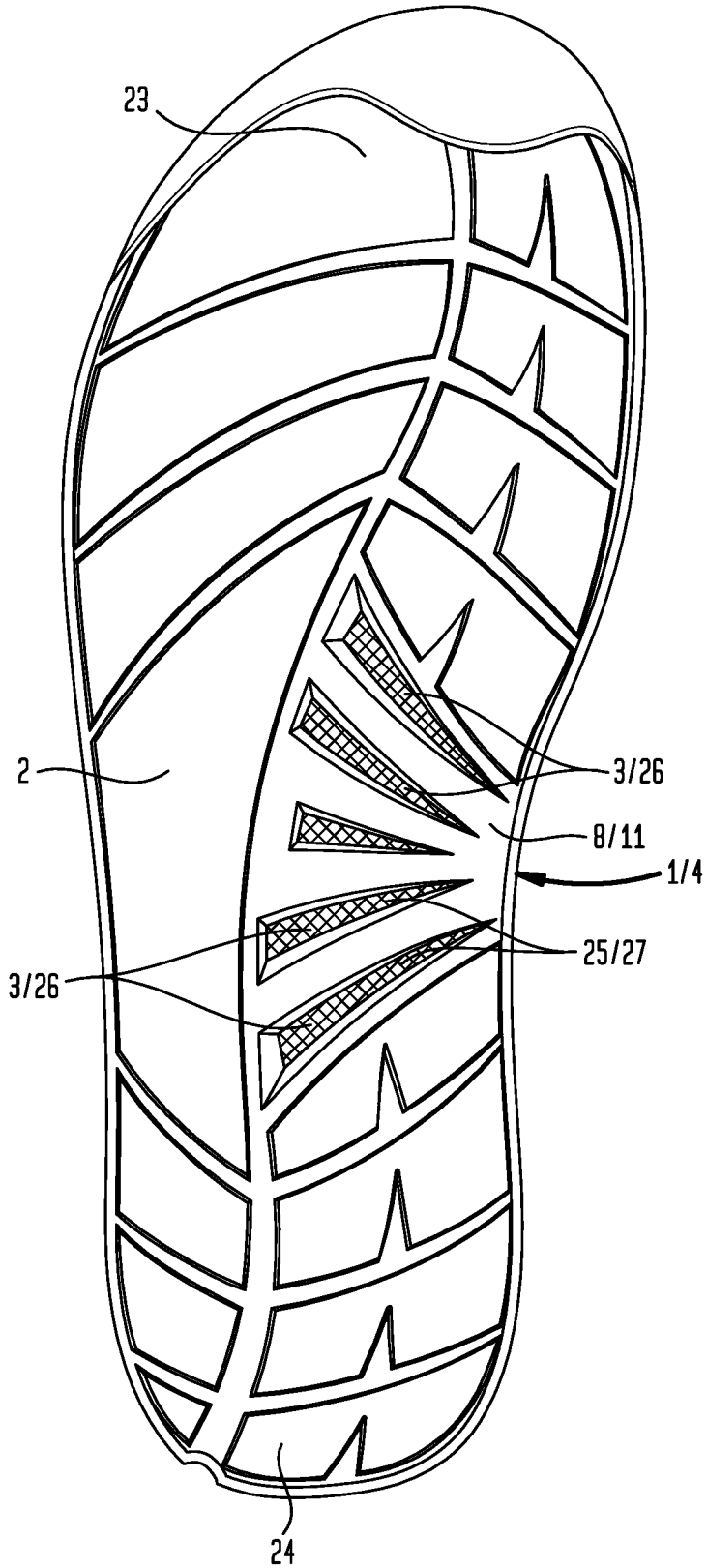
FIG. 5 is a top view of the particular embodiment of the sole and closable drainage system shown in FIG. 2.
Figure 6B:
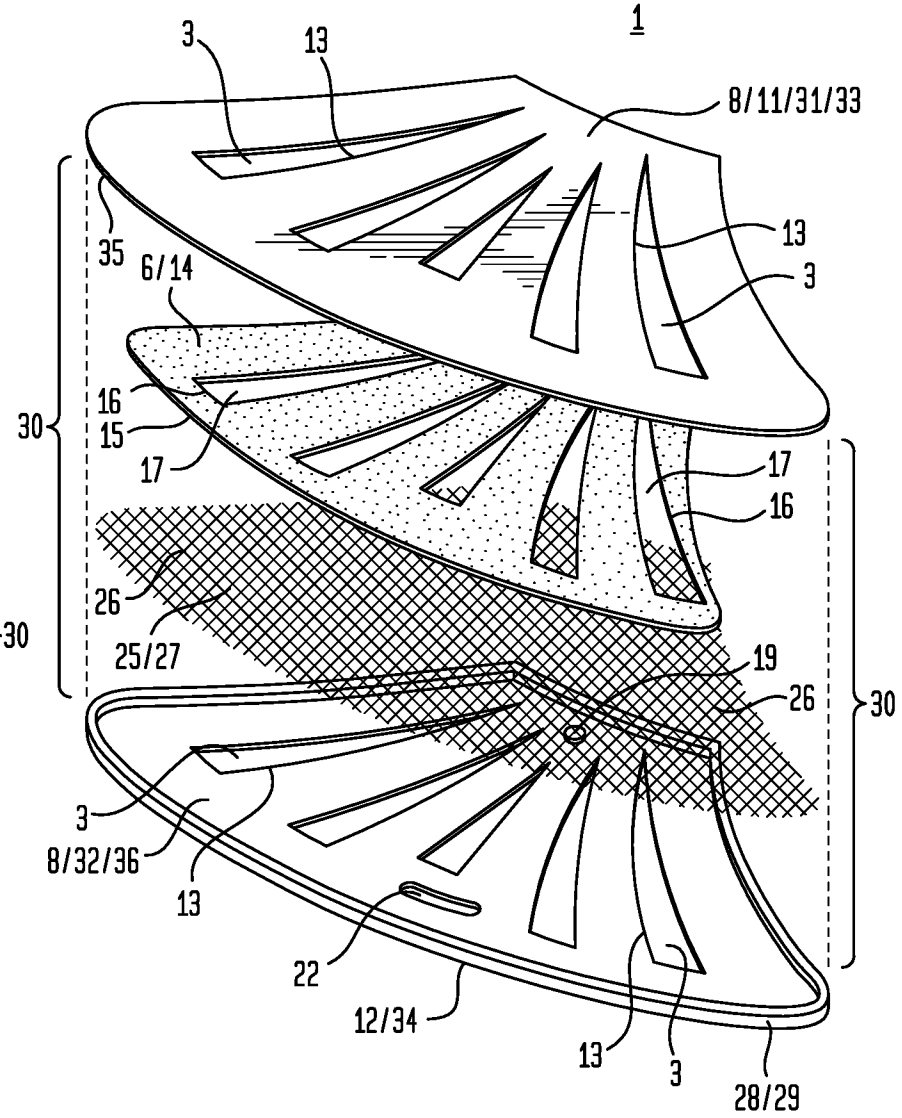
FIG. 6B is an exploded perspective view of a particular embodiment of the closable drainage system.
Figure 6A:
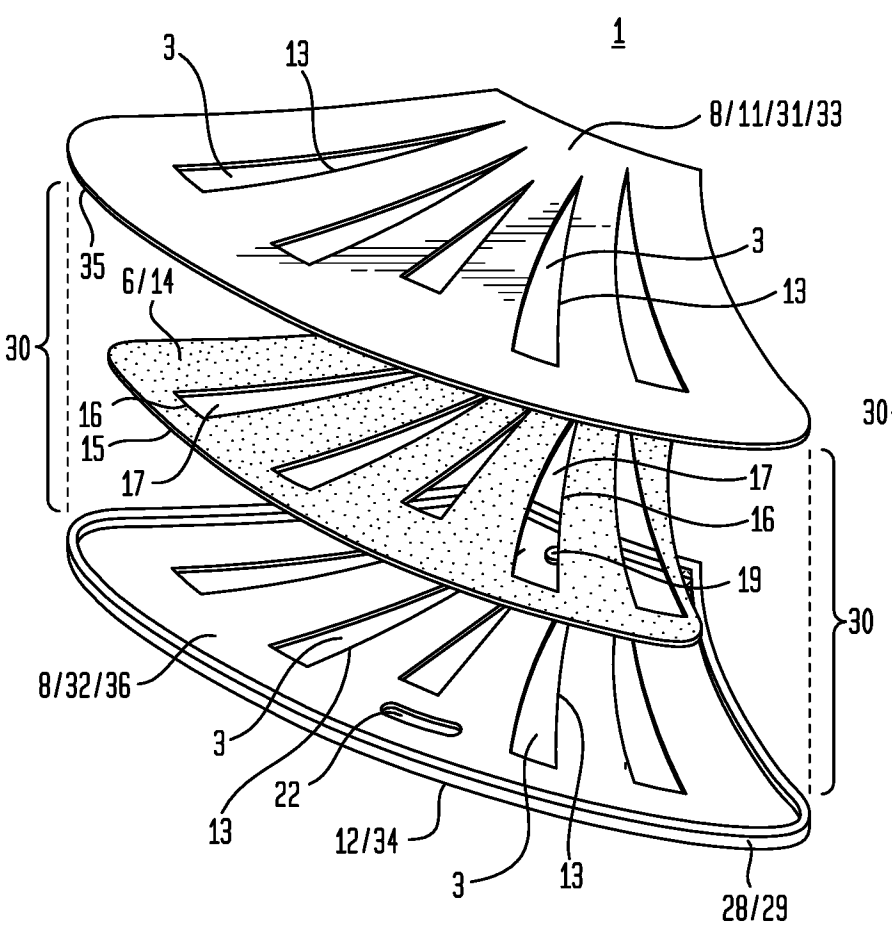
FIG. 6A is an exploded perspective view of a particular embodiment of the closable drainage system.
Figure 6D:
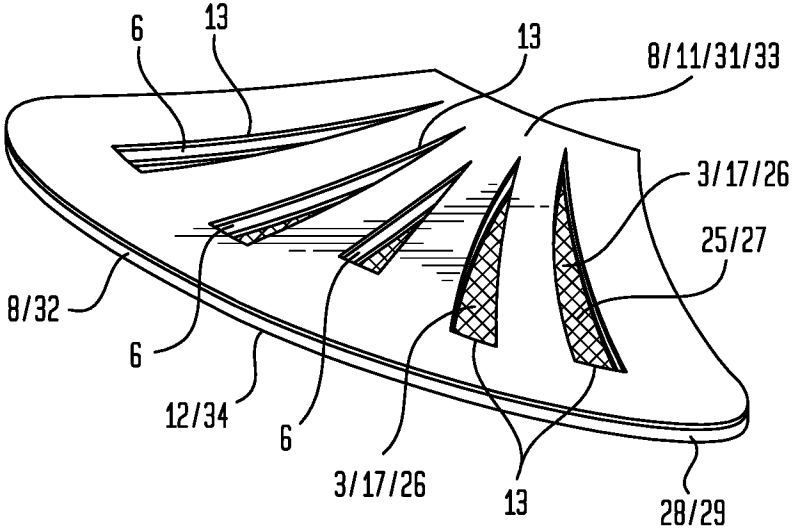
FIG. 6D is a perspective view of the particular embodiment of the closable drainage system shown in FIG. 6B and FIG. 6C.
Figure 6C:
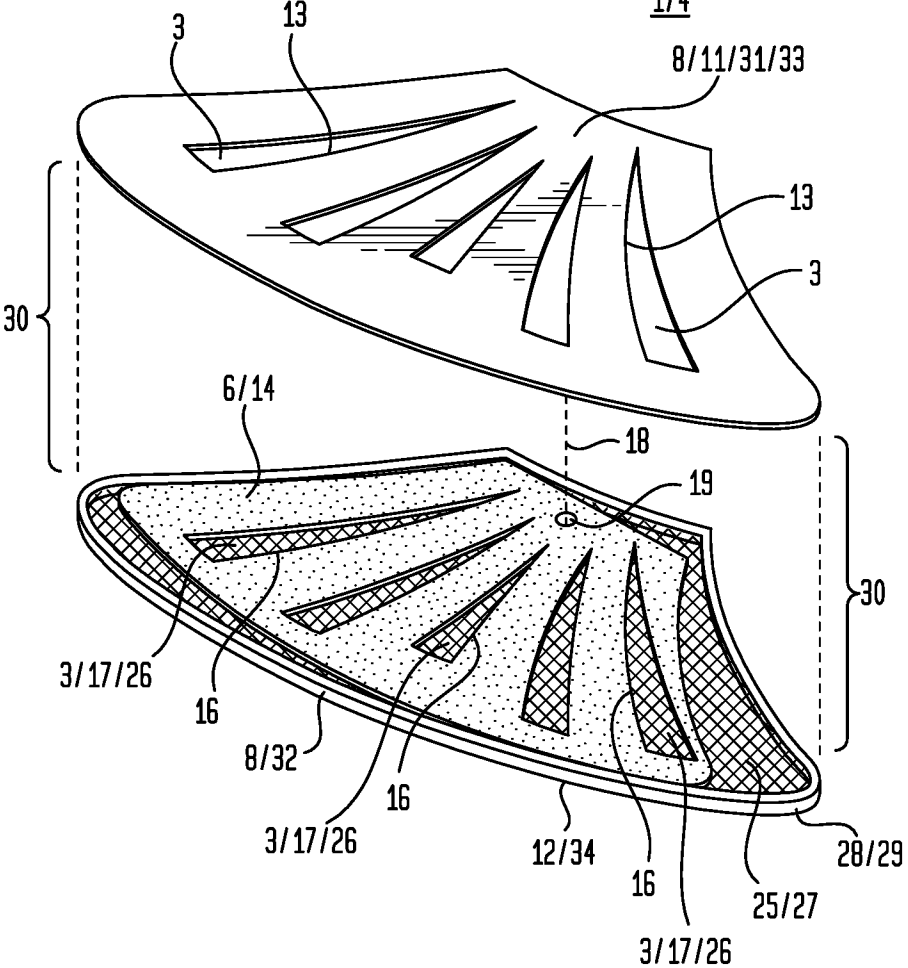
FIG. 6C is a partially exploded perspective view of the particular embodiment of the closable drainage system shown in FIG. 6B.

Now referring primarily to FIG. 1, which illustrates a method of using a particular embodiment of a closable drainage system (1) disposed within a sole (2) of a shoe, whereby the closable drainage system (1) includes a drainage channel (3) having an open condition (4) and a closed condition (5), each condition (4)(5) achievable upon movement of a movable member (6) which can be moved to either allow passage through a drainage channel (3) to provide the open condition (4) or preclude passage through the drainage channel (3) to provide the closed condition (5).

As but one illustrative example, the instant closable drainage system (1) may be useful when a shoe incorporating this innovation is worn both in and out of water. For example, when a wearer is in the water, the open condition (4) of the drainage channel (3) can facilitate the passage of fluid (7) between the interior space defined by the shoe and the water, thus equilibrating the shoe's interior space with its environment. Upon exiting from the water, the open condition (4) of the drainage channel (3) can facilitate the downwardly-directed passage of fluid (7) to allow fluid (7) retained within the shoe to passively drain from within the shoe's interior space such that the shoe is not saturated with water, full of water, waterlogged, or the like, when worn out of the water. Subsequently, the movable member (6) can be moved to provide the closed condition (5) of the drainage channel (3) to preclude ground material, for example sand, pebbles, dirt, or the like, from upwardly-directed passage into the shoe's interior space.

The term "sole" as used herein means the portion of a shoe having a bottom or bottommost surface configured to contact a ground surface and an opposing upper or uppermost surface configured to dispose proximate the foot and particularly, the sole of the foot, of the shoe's wearer.

The term "fluid" as used herein typically refers to a flowable liquid such as water but can, as to particular embodiments, refer to a flowable gas.

Now referring primarily to FIG. 2 through FIG. 8B, the closable drainage system (1) for a sole (2) of a shoe includes a drain (8) configured to communicate between or which communicates between sole top and bottom surfaces (9)(10) of the sole (2). The drain (8) has opposing drain upper and lower faces (11)(12), whereby the drain upper face (11) disposes proximate the sole top surface (9) and the drain lower face (12) disposes proximate the sole bottom surface (10). The closable drainage system (1) further includes at least one drainage aperture element (13) disposed within the drain (8), the drainage aperture element (13) defining a drainage channel (3) which communicates between the drain upper and lower faces (11)(12).

Accordingly, the drainage aperture element (13) provides a generally vertical drainage channel (3) through the sole (2), as opposed to a horizontal drainage channel, such that the drainage channel (3) can facilitate the passage of fluid (7) between the sole top and bottom surfaces (9)(10) through the sole (2). As to particular embodiments, the drainage channel (3) can facilitate the downwardly-directed passage of fluid (7) from the sole top surface (9) toward or to the sole bottom surface (10) to permit passive drainage (via gravitational forces) of fluid (7) for egress from the shoe and particularly, for egress from the interior space defined by the shoe.

Regarding fluid flow path, as to particular embodiments, the drainage channel (3) provided by the drainage aperture element (13) can be substantially linear between the drain upper and lower faces (11)(12). As to other particular embodiments, the drainage channel (3) provided by the drainage aperture element (13) can be arcuate or tortuous between the drain upper and lower faces (11)(12).

Again regarding fluid flow path, as to particular embodiments, the drainage channel (3) provided by the drainage aperture element (13) can have a generally uniform width between the drain upper and lower faces (11)(12). As to other particular embodiments, the drainage channel (3) provided by the drainage aperture element (13) can inwardly taper or outwardly flare toward one of the drain upper and lower faces (11)(12).

Now referring to the structure of the drain (8), as to particular embodiments, the drain (8) can be discrete from the sole (2) of the shoe, whereby the drain (8) can be inserted into the sole (2), for example during formation or manufacturing of the shoe, to provide the closable drainage system (1). As to other particular embodiments, the drain (8) and the sole (2) of the shoe can be integrally formed, meaning connected together so as to make up a single complete piece or unit, or so as to work together as a single complete piece or unit, and so as to be incapable of being easily dismantled without destroying the integrity of the piece or unit.

Again referring to the structure of the drain (8), as to particular embodiments, the drain upper and lower faces (11)(12) can be generally planar or flat, together providing a generally planar or flat drain (8). As to particular embodiments, the drain (8) can be made of a semi-rigid material to allow the generally planar or flat drain (8) to have an amount of flexure sufficient to permit the drain (8) to flex in conjunction with the sole (2) when worn by a wearer.

Now referring primarily to FIG. 2 through FIG. 8B, the closable drainage system (1) further includes a movable member (6) which overlays the drain upper face (11), whereby the movable member (6) is movable over the drain upper face (11) to provide the open and closed conditions (4)(5) of the drainage channel (3). Of note, it is herein contemplated that, as to other particular embodiments, the movable member (6) can overlay the drain lower face (12) but for the sake of brevity, the present description and figures will only describe the particular embodiment having the movable member (6) overlaying the drain upper face (11).

To achieve the open condition (4) of the drainage channel (3), the movable member (6) disposes to allow passage through the drainage channel (3), for example to allow the passage of fluid (7) through the drainage channel (3). Conversely, to achieve the closed condition (5) of the drainage channel (3), the movable member (6) disposes to preclude passage through the drainage channel (3), for example to preclude the passage of ground material through the drainage channel (3), or the movable member (6) disposes to occlude the drainage channel (3).

The open condition (4) of the drainage channel (3) can be achieved when the movable member (6) is moved to open the drainage channel (3) such that the drainage channel (3) has an amount of openness which allows the passage of fluid (7) through the drainage channel (3), whereby a lesser amount of openness allows the passage of a relatively lesser amount of fluid (7) through the drainage channel (3) in relation to a greater amount of openness, which allows the passage of a greater amount of fluid (7) through the drainage channel (3). The greatest amount of openness, which allows the passage of the greatest amount of fluid (7) through the drainage channel (3), can be achieved when the movable member (6) disposes such that the drainage channel (3) is completely unoccluded by the movable member (6).

Now referring to the structure of the movable member (6), as to particular embodiments, the movable member (6) can have movable member upper and lower faces (14)(15) which can be generally planar or flat, together providing a generally planar or flat movable member (6). As to particular embodiments, the movable member (6) can be made of a semi-rigid material to allow the generally planar or flat movable member (6) to have an amount of flexure sufficient to permit the movable member (6) to flex in conjunction with the drain (8) and the sole (2) when worn by a wearer.

Again referring primarily to FIG. 2 through FIG. 8B, the movable member (6) can, but need not necessarily, further include at least one movable member aperture element (16) disposed within the movable member (6), the movable member aperture element (16) defining a movable member aperture element opening (17) which communicates between the movable member upper and lower faces (14)(15).

As to these particular embodiments, the movable member (6) can move over the drain upper face (11) to provide the open condition (4) of the drainage channel (3) such that the movable member aperture element opening (17) aligns, whether partially or completely, with the drainage channel (3) to allow passage through the drainage channel (3), for example to allow the passage of fluid (7) through the drainage channel (3). Following, the greatest amount of openness, which allows the passage of the greatest amount of fluid (7) through the drainage channel (3), can be achieved when the movable member aperture element opening (17) completely aligns with the drainage channel (3) or is coincident with the drainage channel (3). Thus, the drainage channel (3) is completely unoccluded by the movable member (6).

In contrast, to achieve the closed condition (5) of the drainage channel (3), the movable member (6) can move over the drain upper face (11) to offset the movable member aperture element opening (17) and the drainage channel (3) such that the movable member (6) disposes to preclude passage through the drainage channel (3), for example to preclude the passage of ground material through the drainage channel (3), or the movable member (6) disposes to occlude the drainage channel (3).

The drainage aperture element (13) and the movable member aperture element (16) can define a corresponding drainage channel (3) and movable member aperture element opening (17) having any of a numerous and wide variety of configurations of varying dimensions, which can be the same or different, alignable to provide the open condition (4) of the drainage channel (3) to allow passage through the drainage channel (3), for example to allow the passage of fluid (7) through the drainage channel (3).

Accordingly, as non-limiting examples, each of the drainage channel (3) and the movable member aperture element opening (17) can have a cross-section configured as a circle, an oval, an ellipse, a triangle, a square, a rectangle, a polygon, a freeform configuration, or the like, or combinations thereof. As but one illustrative example, both the drainage channel (3) and the movable member aperture element opening (17) can have a generally triangular cross-section (as shown in the examples of the Figures).

Now regarding movement, the movable member (6) can move over the drain upper face (11) by any of a numerous and wide variety moving processes to provide the open and closed conditions (4)(5) of the drainage channel (3).

As but one illustrative example, the movable member (6) can be slidably engaged with the drain (8) to slidably move over the drain upper face (11) along a movement axis which is generally parallel with the drain upper face (11) to provide the open and closed conditions (4)(5) of the drainage channel (3). For example, the movable member (3) can provide the open condition (4) of the drainage channel (3) upon slidable movement toward or to an end of the drain upper face (11); likewise, the movable member (6) can provide the closed condition (5) of the drainage channel (3) upon slidable movement toward or to an opposing end of the drain upper face (11).

Now referring primarily to FIG. 7A through FIG. 8B, as another illustrative example, the movable member (6) can be pivotally engaged with the drain (8) to pivot over the drain upper face (11) about a pivot axis (18) to provide the open and closed conditions (4)(5) of the drainage channel (3). As to these particular embodiments, the movable member (6) and the drain (8) can be pivotally coupled, directly pivotally coupled, or pivotally connected by a pivot element (19), for example via a pin or a rivet, which defines the pivot axis (18) about which the movable member (6) can pivot.

Movement of the movable member (6) over the drain upper face (11) can be facilitated by an actuation element (20) coupled to the movable member (6). As but one illustrative example, the actuation element (20) can be configured as a protrusion (21) which outwardly extends from the movable member lower face (15) and through an elongate hole (22) disposed within the drain (8) (or as to particular embodiments, within the sole (2)) such that the protrusion (21) can be accessed from proximate the drain lower face (12) to facilitate movement of the movable member (6) over the drain upper face (11).

Figure 7A:
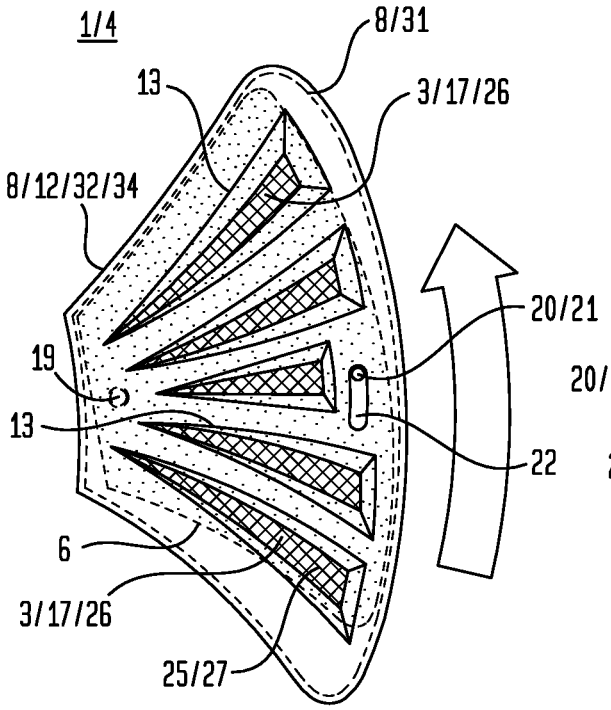
FIG. 7A is a bottom view of a particular embodiment of the closable drainage system having a movable member disposed to provide an open condition of a drainage channel.
Figure 7B:
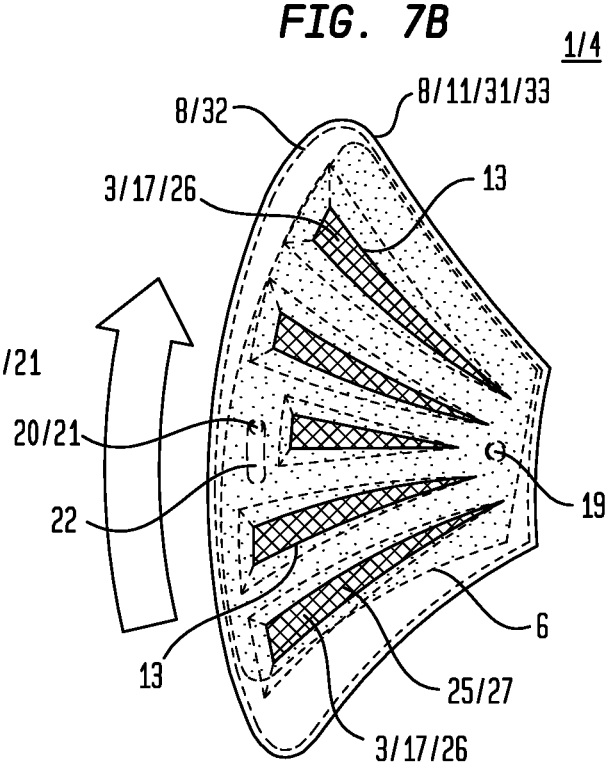
FIG. 7B is a top view of the particular embodiment of the closable drainage system shown in FIG. 7A.

Now referring primarily to FIG. 7A and FIG. 7B, as but one illustrative example, movement of the protrusion (21) which outwardly extends from the movable member lower face (15) and through the elongate hole (22) disposed within the drain (8) toward a toe-accommodating portion (23) of the sole (2) can move the movable member (6) over the drain upper face (11) to provide the open condition (4) of the drainage channel (3), whereby the movable member (6) disposes such that the movable member aperture element opening (17) aligns, whether partially or completely, with the drainage channel (3) to allow passage through the drainage channel (3). Accordingly, fluid (7) can pass through the drainage channel (3) and correspondingly, between the sole top and bottom surfaces (9)(10).

Figure 8A:
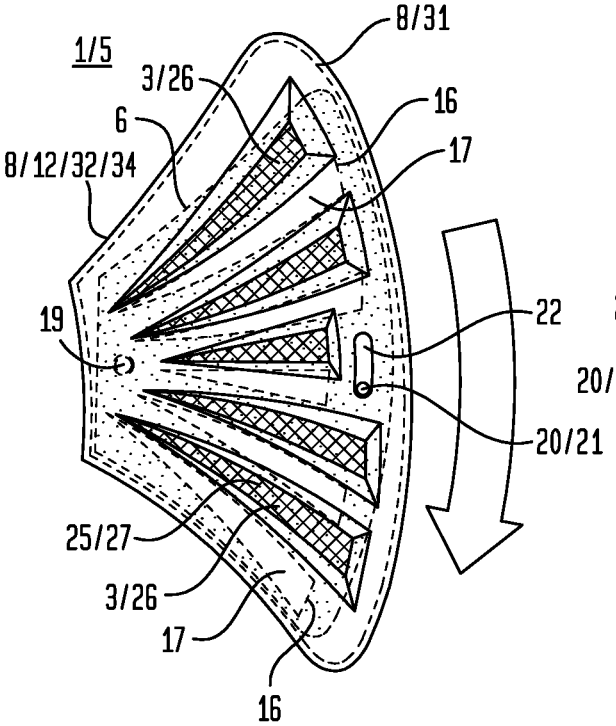
FIG. 8A is a bottom view of a particular embodiment of the closable drainage system having a movable member disposed to provide a closed condition of a drainage channel.
Figure 8B:
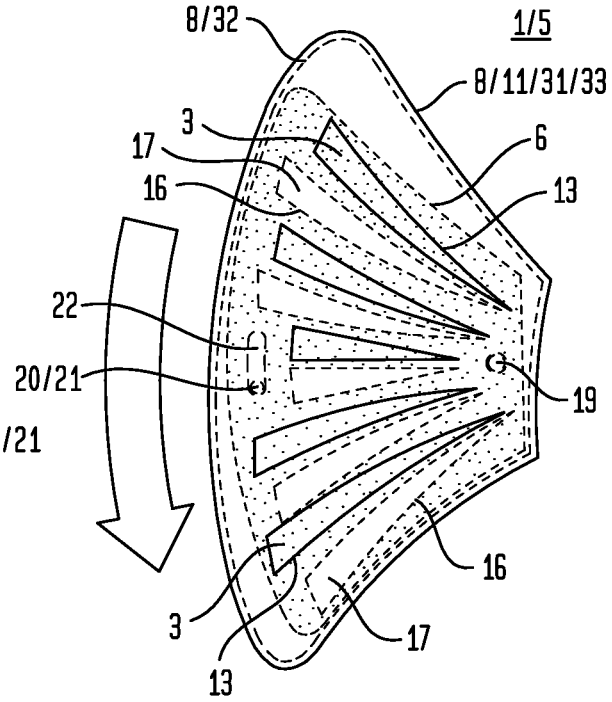
FIG. 8B is a top view of the particular embodiment of the closable drainage system shown in FIG. 8A.

Now referring primarily to FIG. 8A and FIG. 8B, following the above illustrative example, movement of the protrusion (21) which outwardly extends from the movable member lower face (15) and through the elongate hole (22) disposed within the drain (8) toward a heel-accommodating portion (24) of the sole (2) can pivot the movable member (6) over the drain upper face (11) to provide the closed condition (5) of the drainage channel (8), whereby the movable member (6) disposes to preclude passage through the drainage channel (3) or occlude the drainage channel (3). Accordingly, ground material can be precluded from passing through the drainage channel (3) and correspondingly, between the sole top and bottom surfaces (9)(10).

Now referring primarily to FIG. 1 through FIG. 5 and FIG. 6B through FIG. 8B, as to particular embodiments, the closable drainage system (1) can, but need not necessarily, further include a porous layer (25) which overlays or intersects the drainage channel (3) to act as a filter or screen and thereby prevent materials which have greater dimensions than pores (26) disposed within the porous layer (25) from passing through the pores (26) and correspondingly, the drainage channel (3), while allowing materials which have lesser dimensions than the pores (26) to pass through the pores (26), and correspondingly, the drainage channel (3).

Again referring primarily to FIG. 1 through FIG. 5 and FIG. 6B through FIG. 8B, as but one illustrative example, the porous layer (25) can be disposed proximate or adjacent to the drain upper face (11) and accordingly, between the drain upper face (11) and the movable member lower face (15).

Now referring to structure, the porous layer (25) can be formed from any of a numerous and wide variety of porous materials which can have pores (26) of varying dimensions, depending upon the application. As but one illustrative example, the porous layer (25) can be formed from a mesh (27) or a mesh-like material. As to particular embodiments, the porous layer (25) can be air-permeable and water-permeable.

Now referring primarily to FIG. 6A through FIG. 8B, as to particular embodiments, the drain (8) can, but need not necessarily, further include a drain wall (28) which upwardly extends from the drain upper face (11) about a drain periphery (29). The drain wall (28) can define a drain interior cavity (30) which can be configured to movably receive the movable member (6) to dispose the movable member (6) over the drain upper face (11).

Again referring primarily to FIG. 6A through FIG. 8B, as to particular embodiments, the drain (8) can, but need not necessarily, be configured to have drain upper and lower components (31)(32) which can overlayingly engage with one another to provide a drain interior cavity (30) therebetween.

When incorporated into the sole (2) of a shoe, the drain upper component (31) and particularly, a drain upper component upper face (33), can dispose proximate the sole top surface (9), and the drain lower component (32) and particularly, a drain lower component lower face (34), can dispose proximate the sole bottom surface (10).

The drain upper and lower components (31)(32) each have at least one drainage aperture element (13) disposed therein, whereby the drainage aperture elements (13) align with one another to provide a drainage channel (3) which communicates between the drain upper component upper face (33) and the drain lower component lower face (34) and correspondingly, between the sole top and bottom surfaces (9)(10), to facilitate the passage of fluid (7) between the sole top and bottom surfaces (9)(10) through the sole (2).

The drain interior cavity (30) provided by overlaying drain upper and lower components (31)(32) can be configured to movably receive the movable member (6) to dispose the movable member (6) between the drain upper and lower components (31)(32). Accordingly, the movable member upper face (14) disposes proximate a drain upper component lower face (35) and the movable member lower face (15) disposes proximate a drain lower component upper face (36). Thus, upon actuation of the actuation element (20), the movable member (6) can move, whether slidably or pivotally, within the drain interior cavity (30) to achieve the open and closed conditions (4)(5) of the drainage channel (3).

Regarding production, a method of making a particular embodiment of the closable drainage system (1) for a sole (2) of a shoe includes providing a drain (8) configured to communicate between sole top and bottom surfaces (9)(10) of the sole (2), the drain (8) having opposing drain upper and lower faces (11)(12); disposing at least one drainage aperture element (13) within the drain (8), the drainage aperture element (13) defining a drainage channel (3) which communicates between the drain upper and lower faces (11)(12); and overlaying the drain upper face (11) with a movable member (6), the movable member (6) movable over the drain upper face (11) to provide open and closed conditions (4)(5) of the drainage channel (5). In the open condition (4), the movable member (6) disposes to allow passage through the drainage channel (3) and correspondingly, between the sole top and bottom surfaces (9)(10). In the closed condition (5), the movable member (6) disposes to preclude passage through the drainage channel (3) and correspondingly, between the sole top and bottom surfaces (9)(10).

The method of making the closable drainage system (1) can, but need not necessarily, further include providing and configuring additional elements of the closable drainage system (1) as above described.

The closable drainage system (1) or elements of the closable drainage system (1) can be made from any of a numerous and wide variety of materials, depending upon the application. As non-limiting examples, the material can include plastic, plastic-like material, rubber, rubber-like material, or the like, or combinations thereof.

The closable drainage system (1) or elements of the closable drainage system (1) can be made by any of a numerous and wide variety of processes, depending upon the application. As non-limiting examples, the process can include press molding, injection molding, fabrication, machining, printing, additive printing, or the like, or combinations thereof.

As but one illustrative example, each of the drain (8) and the movable member (6) can be formed from injection molding by injecting moldable material, such as a thermoplastic material, into a mold. As to particular embodiments, the moldable material can be generally impermeable to fluids (7) such that fluids (7) can only pass between the drain upper and lower faces (11)(12) and correspondingly, between the sole top and bottom surfaces (9)(10), via passage through the drainage channel (3) when in the open condition (4).

As to particular embodiments, the drain (8) can be configured as a one-piece drain (8). As to other particular embodiments, the drain (8) can be assembled from a plurality of pieces to provide an assembled drain (8).

As to particular embodiments whereby the drain (8) is configured to have drain upper and lower components (31)(32), the drain upper and lower components (31)(32) can be configured as a one-piece drain (8) having a drain interior cavity (30) therebetween. As to other particular embodiments, the drain (8) can be assembly from discrete drain upper and lower components (31)(32) which matably engage to provide a drain interior cavity (30) therebetween.

Regarding use, a method of using a particular embodiment of the closable drainage system (1) for a sole (2) of a shoe includes obtaining the shoe having the sole (2) with the closable drainage system (1); wearing the shoe, for example on a foot; and moving a movable member (6) of the closable drainage system (1) to provide an open condition (4) or a closed condition (5) of a drainage channel (3) of the closable drainage system (1).

As can be easily understood from the foregoing, the basic concepts of the present invention may be embodied in a variety of ways. The invention involves numerous and varied embodiments of a shoe drainage system and methods for making and using such a shoe drainage system, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "drain" should be understood to encompass disclosure of the act of "draining"—whether explicitly discussed or not—and, conversely, were there effectively disclosure of the act of "draining", such a disclosure should be understood to encompass disclosure of a "drain" and even a "means for draining". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the shoe drainage systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A method of making a closable drainage system for a shoe, comprising:

providing a sole;

coupling a drain to said sole, said drain configured to communicate between sole top and bottom surfaces of said sole, said drain having opposing drain upper and lower faces;

wherein said drain upper face disposes proximate said sole top surface, and said drain lower face disposes proximate said sole bottom surface;

wherein said drain comprises drain upper and lower components which overlayingly engage to provide a drain interior cavity therebetween;

wherein each of said drain upper and lower components comprises at least one drainage aperture element disposed therein, said drainage aperture elements aligned to provide a drainage channel which communicates between said drain upper and lower faces;

movably disposing a movable member within said drain interior cavity to provide open and closed conditions of said drainage channel, an entirety of said movable member enclosed within said drain interior cavity; and wherein said movable member comprises at least one movable member aperture element disposed therein.

2. The method of claim 1, wherein said drainage aperture elements provide a generally vertical drainage channel through said sole.

3. The method of claim 1, wherein said drainage aperture elements provide said drainage channel with a substantially linear path between said drain upper and lower faces.

4. The method of claim 1, wherein said drainage aperture elements provide said drainage channel with a tortuous path between said drain upper and lower faces.

5. The method of claim 1, wherein said drainage aperture elements provide said drainage channel with a generally uniform width between said drain upper and lower faces.

6. The method of claim 1, wherein said drainage aperture elements provide said drainage channel with an inward taper toward one of said drain upper and lower faces.

7. The method of claim 1, wherein said drainage aperture elements provide said drainage channel with an outward flare toward one of said drain upper and lower faces.

8. The method of claim 1, wherein said drain is discrete from said sole, said drain insertable into said sole to provide said closable drainage system.

9. The method of claim 1, wherein said drain and said sole are integrally formed.

10. The method of claim 1, wherein said movable member aperture element defines a movable member aperture element opening which communicates between movable member upper and lower faces;

wherein in said open condition, said movable member aperture element opening aligns with said drainage channel to allow passage between said sole top and bottom surfaces; and wherein in said closed condition, said movable member precludes passage between said sole top and bottom surfaces.

11. The method of claim 1, wherein in said closed condition, said movable member precludes passage between said sole top and bottom surfaces by occluding said drainage channel proximate said drain upper face.

12. The method of claim 1, further comprising slidably engaging said movable member with said drain such that said movable members slides in substantially orthogonal relation to said drainage channel.

13. The method of claim 1, further comprising pivotally engaging said movable member with said drain.

14. The method of claim 13, further comprising pivotally coupling said movable member and said drain via a pivot element.

15. The method of claim 1, further comprising:

coupling an actuation element to said movable member;

wherein said actuation element facilitates movement of said movable member within said drain interior cavity.

16. The method of claim 15, wherein said actuation element comprises a protrusion which outwardly extends from a movable member lower face; and wherein said actuation element extends through a hole disposed within said drain.

17. The method of claim 16, wherein said actuation element is accessible from proximate said drain lower face to facilitate movement of said movable member over said drain upper face.

18. The method of claim 1, further comprising overlaying said drainage channel with a porous layer.

19. The method of claim 1, wherein said drain upper component overlays a movable member upper face and said drain lower component overlays a movable member lower face to enclose said movable member within said drain interior cavity.

* * * * *